US011346125B2

(12) United States Patent
Moreno et al.

(10) Patent No.: US 11,346,125 B2
(45) **Date of Patent: *May 31, 2022**

(54) FENCING SYSTEM

(71) Applicant: Master-Halco, Inc., Dallas, TX (US)

(72) Inventors: Jason Moreno, Dallas, TX (US); Jerry Short, Washougal, WA (US); Tim O'Brien, Belvidere, NJ (US)

(73) Assignee: Master-Halco, Inc., Dallas, TX (US)

( * ) Notice: Subject to any disclaimer, the term of this patent is extended or adjusted under 35 U.S.C. 154(b) by 861 days.

This patent is subject to a terminal disclaimer.

(21) Appl. No.: 15/909,346

(22) Filed: Mar. 1, 2018

(65) Prior Publication Data

US 2019/0063107 A1 Feb. 28, 2019

Related U.S. Application Data

(63) Continuation of application No. 15/687,372, filed on Aug. 25, 2017, now Pat. No. 9,909,337.

(51) Int. Cl.
*E04H 17/20* (2006.01)
*E04H 17/14* (2006.01)
*E04H 17/22* (2006.01)

(52) U.S. Cl.
CPC ..... *E04H 17/20* (2013.01); *E04H 17/1417* (2013.01); *E04H 17/1447* (2021.01); *E04H 17/22* (2013.01); *E04H 17/1452* (2021.01)

(58) Field of Classification Search
CPC ..... E04H 17/1417; E04H 17/1421; E04H 17/1434; E04H 17/1439; E04H 17/20; E04H 2017/1447; E04H 2017/1452; E04H 2017/146; E04H 17/22
USPC ..... 248/218.4, 219.1, 224.8; 256/65.02, 256/DIG. 5
See application file for complete search history.

(56) References Cited

U.S. PATENT DOCUMENTS 492,876 A * 3/1893 Rosback et al. .... E04H 17/1413 256/68
589,079 A * 8/1897 Glazier ..... E04H 12/2215 52/165
931,616 A 8/1909 Johanning
(Continued)

FOREIGN PATENT DOCUMENTS

AU 2011101561 1/2012
DE 4435967 4/1996
(Continued)

OTHER PUBLICATIONS

"Postmaster," http:--www.homedepot.com-p-Master-Halco-7-ft-6-in-Postmaster-633663-202091158, dated Apr. 2, 2017.
(Continued)

*Primary Examiner* — Matthew R McMahon
(74) *Attorney, Agent, or Firm* — Knobbe, Martens, Olson & Bear LLP

(57) ABSTRACT

An improved fencing system can include an improved fence posts. Such fence posts can include features for accommodating different types of fasteners for attachment to fence components, such as fence rails. Additionally, some fence posts, such as gateposts, can be formed with one or more pieces of other fenceposts in a fencing system. Some such improved fence posts can include concrete locks.

20 Claims, 14 Drawing Sheets

(56) References Cited

U.S. PATENT DOCUMENTS

| | | | | |
|---|---|---|---|---|
| 1,123,105 | A * | 12/1914 | Crews | E04H 12/2215 52/165 |
| 1,867,816 | A | 7/1932 | Finkbeiner | |
| 3,942,763 | A | 3/1976 | Helterbrand et al. | |
| 4,329,826 | A * | 5/1982 | Flogaus | E04B 1/41 52/295 |
| 4,386,762 | A | 6/1983 | Collins | |
| 4,543,757 | A * | 10/1985 | Cosgrove | E02D 27/42 248/158 |
| 4,646,489 | A * | 3/1987 | Feller | E04H 12/2253 256/DIG. 5 |
| 4,668,000 | A | 5/1987 | Jokela | |
| 4,924,648 | A * | 5/1990 | Gilb | E04B 1/41 52/295 |
| 5,203,817 | A * | 4/1993 | Klumpjan | E04H 12/2276 256/19 |
| 5,277,408 | A | 1/1994 | Parker | |
| 5,452,880 | A | 9/1995 | Dailey | |
| 5,494,261 | A | 2/1996 | Gandara | |
| 5,613,664 | A | 3/1997 | Svalbe | |
| 5,628,495 | A | 5/1997 | Gandara | |
| 5,729,939 | A * | 3/1998 | Di Benedetto | E04B 1/41 52/293.3 |
| 5,788,224 | A | 8/1998 | Platt | |
| 5,813,182 | A * | 9/1998 | Commins | E02D 27/01 52/295 |
| 6,061,991 | A | 5/2000 | Dahl | |
| 6,173,945 | B1 | 1/2001 | Lindsey et al. | |
| 6,298,609 | B1 * | 10/2001 | Bifano | E04B 1/765 52/101 |
| 6,343,446 | B1 | 2/2002 | Beard | |
| 6,530,561 | B2 | 3/2003 | Larsen et al. | |
| 6,666,625 | B2 | 12/2003 | Thornton | |
| 7,125,002 | B2 | 10/2006 | Platt | |
| 7,147,213 | B1 | 12/2006 | Amendola | |
| 7,178,789 | B1 | 2/2007 | Lehmann | |
| 7,571,897 | B2 | 8/2009 | Heinz | |
| 7,980,034 | B2 | 7/2011 | Fehr et al. | |
| 7,980,533 | B1 | 7/2011 | Anderson et al. | |
| 8,028,974 | B2 | 10/2011 | Mann | |
| 8,382,070 | B1 | 2/2013 | Gibbs | |
| 8,584,413 | B1 * | 11/2013 | Keller, Sr. | E02D 27/32 52/297 |
| 8,955,250 | B2 | 2/2015 | Johnson et al. | |
| 9,115,506 | B2 | 8/2015 | Hill | |
| 9,518,404 | B2 | 12/2016 | Volin | |
| 9,551,457 | B2 | 1/2017 | Johns et al. | |
| 9,909,337 | B1 | 3/2018 | Moreno et al. | |
| 10,676,958 | B2 | 6/2020 | Short et al. | |
| 2003/0209701 | A1 | 11/2003 | Goddard | |
| 2005/0269558 | A1 | 12/2005 | Keefe | |
| 2006/0175594 | A1 | 8/2006 | Burkart et al. | |
| 2007/0034847 | A1 | 2/2007 | Shertzer et al. | |
| 2008/0128672 | A1 | 6/2008 | Van Fleet | |
| 2008/0277543 | A1 * | 11/2008 | Daysh | E04H 17/22 248/205.1 |
| 2008/0296547 | A1 | 12/2008 | Renteria | |
| 2010/0001247 | A1 | 1/2010 | Jaimes | |
| 2010/0108969 | A1 | 5/2010 | Platt | |
| 2013/0207062 | A1 | 8/2013 | Guthrie et al. | |
| 2014/0264220 | A1 | 9/2014 | Doyle | |
| 2015/0204106 | A1 * | 7/2015 | Hedley | E04H 17/26 256/32 |
| 2015/0233141 | A1 | 8/2015 | Taylor et al. | |
| 2015/0248851 | A1 | 9/2015 | Stoddard et al. | |
| 2016/0025241 | A1 | 1/2016 | Johns et al. | |
| 2016/0145893 | A1 | 5/2016 | Coulston et al. | |

FOREIGN PATENT DOCUMENTS

| | | |
|---|---|---|
| EP | 0598456 | 5/1994 |
| EP | 2666934 | 1/2015 |
| FR | 2233861 | 1/1975 |
| GB | 128715 | 6/1919 |
| GB | 165884 | 7/1921 |
| GB | 1538955 | 1/1979 |
| GB | 2464760 | 5/2010 |
| GB | 2466778 | 7/2010 |
| KR | 101616000 | 4/2016 |
| WO | WO 2014040091 | 3/2014 |

OTHER PUBLICATIONS

"Z Post," http:--www.homedepot.com-p-ZPost 16inx475inx75ftGalvanizedSteelFencePostZP76-205709561, dated Apr. 3, 2017.

* cited by examiner

FENCING SYSTEM

CROSS REFERENCE OF RELATED APPLICATION

This application is a continuation of U.S. patent application Ser. No. 15/687,372, filed on Aug. 25, 2017, titled FENCING SYSTEM which is incorporated by reference herein in entirety. Any and all applications for which a foreign or domestic priority claim is identified in the Application Data Sheet as filed with the present application are hereby incorporated by reference under 37 C.F.R. § 1.57.

BACKGROUND

Field of the Inventions

The present inventions generally relate to fencing systems, and in particular, fencing systems which include improved fence posts, gateposts and posts with concrete locks which can be used in conjunction with fencing systems.

Description of the Related Art

Traditionally, wooden fence posts have been used to construct wooden fences. Wooden fences are desirable because of the appearance of the fence, especially for residential homes.

It is also known to use galvanized steel post components having various different cross-sectional configurations. Some designs, such as those disclosed in U.S. Pat. No. 6,173,945, include wooden fencing systems with steel posts having a channel-shaped configuration and which can be directly attached to wooden fence rails and other wooden components.

SUMMARY

An aspect of at least one of the inventions disclosed herein includes the realization that fence posts can more readily accommodate diverse types of fasteners and installation options if they are pre-drilled with different types of fastener apertures. For example, where a fence post is provided with alternating patterns of different types of fastener apertures, an installer of a fence can arbitrarily, at the time of construction, choose between a plurality of different fasteners for building the fence. Further, an installer may choose to use one type of fastener in one portion of a fence, and a different fastener in a different area of the fence. However, with such an accommodating fence post having alternating patterns of different types of openings, an installer can benefit from the dual advantages of utilizing the same fence post at various locations and different fasteners at different locations along the fence.

Thus, in accordance with some embodiments, a fencepost for can comprise an elongated fencepost member having a lower end and an upper end, the lower end configured to be inserted into the ground. A flange can be connected to the elongated fencepost member. The flange can include a plurality of openings arranged longitudinally along the flange, the openings including at least two straight openings and at least two countersunk openings arranged in an alternating pattern.

Another aspect of at least some of the inventions disclosed herein includes the realization that a fencing system can be built in a more efficient and cost-effective manner by building disparate components using some common parts. For example, a fencing system typically includes fenceposts used for supporting spans of longitudinally arranged fencing, which are subjected to certain forces. Such fencing systems also typically include gateposts which support a swinging gate, for example, where such gateposts are subjected often to substantially higher loads generated by the swinging gate assembly. Thus, typically, fenceposts and gateposts of a single fencing system are made from different parts. If they were made from the same part, designed to withstand the greater maximum loads of the gate post use, then the other fenceposts would typically be over-engineered and thus more expensive than necessary.

Thus, in some embodiments, a fencing system includes a plurality of fenceposts made from a first post member and at least one gate post formed of one of the first post members and a secondary layer having a complimentary cross-sectional shape to that of the fencepost. As such, a gatepost can be partially constructed from the same parts forming the gateposts, thereby reducing costs and complexity of a fencing system design.

Another aspect of at least one of the inventions disclosed herein includes the realization that concrete typically used for footings for fence posts can include significant amounts of granular materials, such as stones, which can have one or more dimensions of about 1½ inches or more, some of such granular materials having non-uniform and non-round shapes. The inclusion of granular materials of such dimensions can negatively impact the flowability of the concrete when the concrete is poured during construction of a footing. Thus, when used for a fence post footing, the larger granular materials can impede flow of the associated concrete through an aperture in a lower end of a footing.

Thus, in accordance with some embodiments, a fence post can include a concrete lock aperture having at least one dimension of at least about 2.5 inches and in some embodiments, at least about three-inches. With such a configuration, the concrete lock aperture can better allow larger pieces of granular material included in the concrete during construction of a footing to flow through the concrete lock and prevent the blockage of the concrete lock and thereby prevent the formation of large voids around the concrete lock and provide better anchoring of the associated fence post in the footing.

DETAILED DESCRIPTION

The present inventions are disclosed in the context of improved metal fenceposts for use with wooden fencing systems because they have particular utility in this context. However, the inventions disclosed herein can be used in other contexts. Thus, the principles of the present inventions are not limited to metal fenceposts used with wooden fences. It is understood, in light of the present disclosure, that the fenceposts disclosed herein can be successfully used in connection with other types of fences, walls, and barriers.

Additionally, to assist in the description of the embodiments of fenceposts and fencing systems disclosed herein, words such as upward, downward, vertical, and horizontal are used to describe the accompanying figures. However, the present inventions can be located in a variety of desired positions, including various angles, sideways, and even upside down. A detailed description of the fencing system is set forth below.

Figure 1:
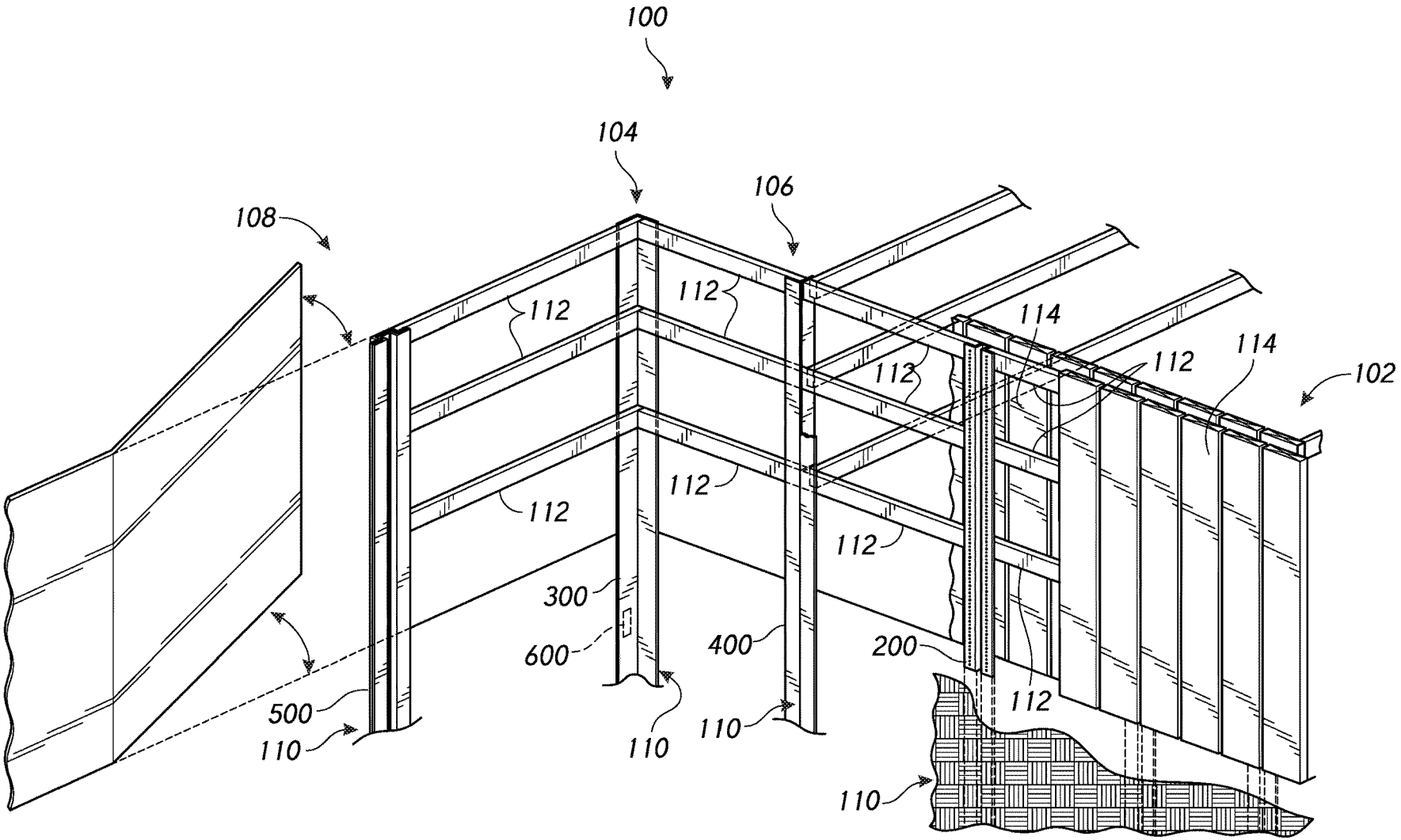
FIG. 1 is perspective view of a fencing system in accordance with an embodiment, including straight fencing sections, corner fencing sections, a T section, and a gate assembly.

With reference to FIG. 1, an embodiment of a fencing system 100 can include various different sections of fencing. For example, the fencing system 100 can include straight sections 102, corner sections 104, T-sections 106, gate assemblies 108, and/or other flat or curved sections (not shown). The embodiment of the fencing system 100 includes certain components designed for use in the respective sections 102, 104, 106, 108.

In some embodiments, straight sections 102 of the fencing system 100 can be constructed with fenceposts 200. Corner sections 104 can be constructed with corner posts 300. T-joint sections 106 can be constructed with T-posts 400, and gate assemblies 108 can be constructed with one or more gate posts 500. Any one or all of the posts 200, 300, 400, 500 can optionally include one or more concrete locks 600 (only one being illustrated on corner post 300 in FIG. 1).

The various posts 200, 300, 400, 500, with or without optional concrete locks 600, can be used to support various sections of the fencing system 100, such as sections 102, 104, 106, 108, and/or other sections or types of fencing. The fencing system 100 is in the form of a wooden fence having steel posts. In other words, the fencing system 100 appears to be an entirely wooden fence to an observer because the posts 200, 300, 400, 500, as installed in a completed fencing system 100, are almost entirely invisible or substantially invisible to the user.

For example, the fencing system 100 can be constructed by initially installing the posts 200, 300, 400, 500 in various desired locations with concrete footings 110. Other techniques can also be used for securing the posts 200, 300, 400, 500 into the ground. For example, any one or all of the posts 200, 300, 400, 500 can be inserted directly into soil if a user chooses to avoid the cost of concrete footings 110.

With the posts 200, 300, 400, 500 secured into the ground, wood fencing components can be attached thereto. For example, with continued reference to FIG. 1, fence rails 112 can be placed between the posts 200, 300, 400, 500 and secured to flanges thereof (described in greater detail below). With the fence rails 112 in place and secured to the various posts, fence boards 114 can be attached to the fence rails. If desired, fence boards 114 can be secured to both sides of the fence rails 112, thereby forming a double layer of fence boards. In this configuration, having two layers of fence boards 114 would provide an outer appearance with a continuous or substantially continuous wooden fence with no metal components visible or easily seen.

Where a fence section is intended to be covered with fence boards 114 on a side with exposed flanges of the posts 200, 300, 400, 500, of the section, it is advantageous if countersunk fasteners are used beneath the boards 114. For example, as viewed in FIG. 1, fence posts 200 includes two flanges on the side facing the viewer of FIG. 1, and wherein the fence rails 112 are secured on the back side of the flanges, as viewed in FIG. 1. In this configuration, different types of fasteners could be used to secure the flanges to the rails 112.

For example, regular screws could be used to attach the flanges to the rails 112. However, if a fence board 114 is placed over the fencepost 200, the protruding heads of the regular screws may make it difficult for the board 114 to be installed in alignment with adjacent boards 114. Thus, a user may choose to use countersunk screws with countersunk holes in the flanges. As such, the screw heads can be installed so that they do not protrude beyond the outer surface of the flange and thus would not interfere with the installation of boards 114, providing for a better alignment of the fence boards 114. The structure and use of fenceposts is described in greater detail below with reference to FIGS. 2-8.

Figure 2:
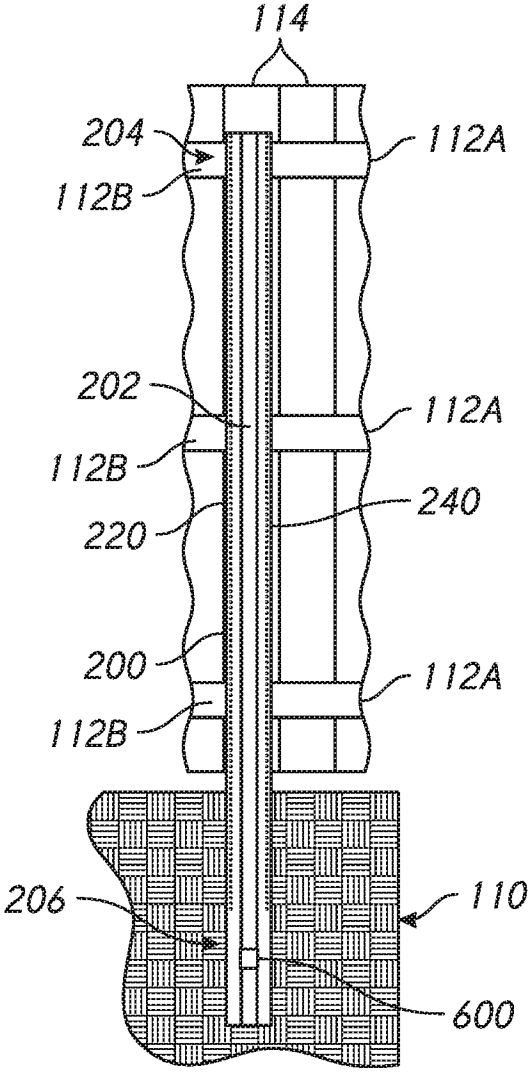
FIG. 2 is a front elevational view of a portion of the fencing system of FIG. 1 illustrating a single fencepost embedded in a concrete footing and supporting a wooden fence structure.

With continued reference to FIGS. 2 and 3, fenceposts 200 includes an elongated fencepost member 202, a first flange 220 and a second flange 240.

The elongated fencepost number 202 can have an upper end 204 and a lower end 206. The lower end can be configured to be inserted into the ground and/or be secured with a concrete footing 110. The upper end 204 can be configured to support fence components, such as components of a wooden fence or fences made from other materials such as those including fence rails 112 and fence boards 114. The post 200 can be used to construct other types of fences as well.

The elongated fence post member 202 can have any cross-sectional shape. In the illustrated embodiment, the elongated fencepost member has a generally U-shaped cross-section. For example, with reference to the top plan view of FIGS. 3A and 3B, the elongated fencepost member 202 can include first sidewall 208, a second sidewall 210, and a center wall 212. The first and second sidewalls 208, 210 extend generally parallel to one another. As used herein, the term "generally parallel" can mean directions that are substantially parallel but not perfectly parallel, for example, they might diverge or converge away from parallel directions by amounts that might result from manufacturing techniques or with otherwise intentional small deviations of about a few degrees.

The center wall 212 connects the sidewalls 208, 210. In some embodiments, the center wall 212 is generally perpendicular to either or both of the sidewalls 208, 210. As used herein, the term "generally perpendicular" includes orientations that are perpendicular or close to perpendicular, including variations that might result from manufacture intolerances or intended deviations from perpendicular within a few degrees.

Together, the first sidewall 208, the second sidewall 210, and the center wall 212 together form a generally U-shaped elongated fencepost member. For example, in some embodiments, the first sidewall 208, the second sidewall 210, and the center wall 212, extend from the upper end 204 to the lower end 206.

Figure 3A:
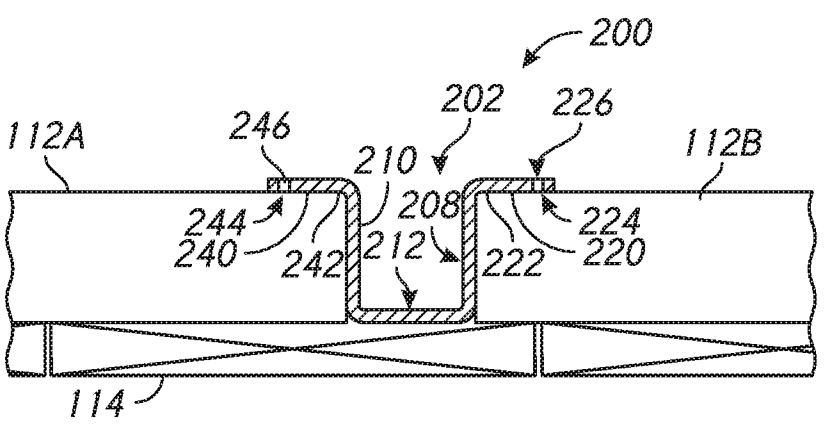
FIG. 3A is a top plan view of the fencing configuration in FIG. 2.
Figure 3B:
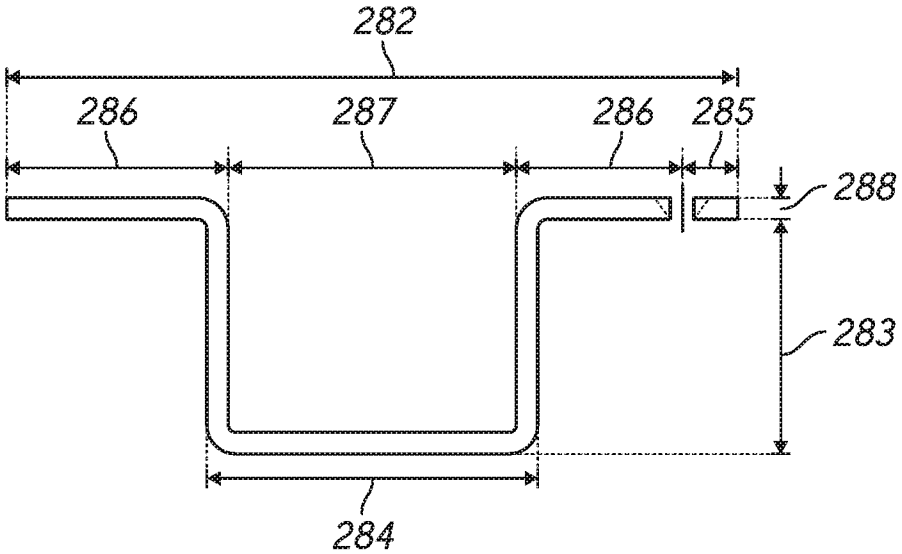
FIG. 3B is an enlarged top plan view of the fencepost of FIG. 2.

With continued reference to FIGS. 3A and 3B, the first flange 220 can include an inner edge 222 and an outer edge 224. The inner edge can be connected to the first sidewall 208. Additionally, the flange 220 can include a plurality of openings 226 configured to receive fasteners for attaching the flange 220 to a fence rail, such as fence rail 112B.

Similarly, the second flange 240 can include an inner edge 242 and an outer edge 244. The inner edge 242 can be connected to the second sidewall 210. The flange 240 can also include a plurality of openings 246 configured to receive fasteners before attaching the flange 240 to a fence rail such as fence rail 112A. The openings 246 can be disposed between the inner edge 242 and the outer edge 244. Similarly, the openings 226 can be disposed between the inner edge 222 and the outer edge 224 of flange 220.

In some embodiments, the elongated fencepost member 202, first flange 220, and second flange 240 can be made from a single monolithic member, for example, from roll formed or stamped steel.

Further, in some embodiments, the post 200 can have an overall width 282 of about 4.5 inches. A hat section of the post can have an outer width 284 of about 2 inches and an inner width 287 of about 1.8 inches. In such embodiments, the thickness 288 can be about 0.1 inches, for example, the thickness 288 can be about 0.12 inches. The post 200 can have a flange width 286 of about 1.3 inches. The plurality of openings 246 can be spaced from the edge of the flange 220 by a spacing 285 of about 0.3 inches. Additionally, the post can have a depth, also referred to a hat depth 283 of about 1.5 inches. Other dimensions can also be used.

Figure 5:
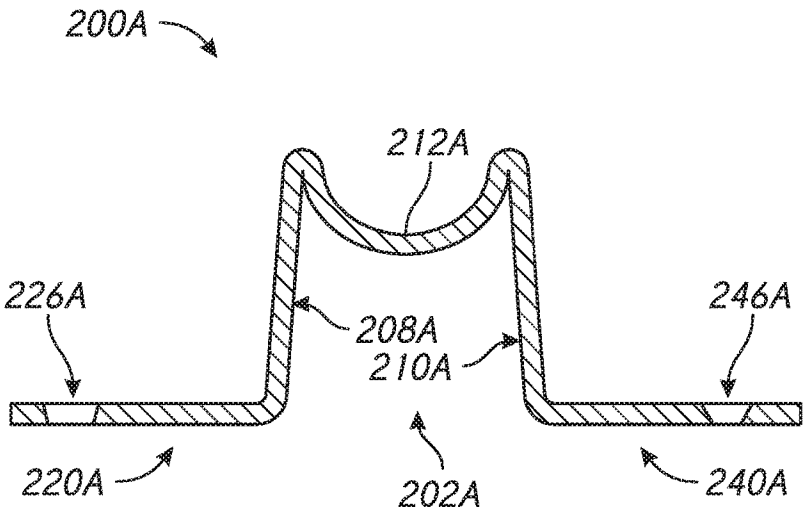
FIG. 5 is a top plan view of the fencepost of FIG. 4.
Figure 4:
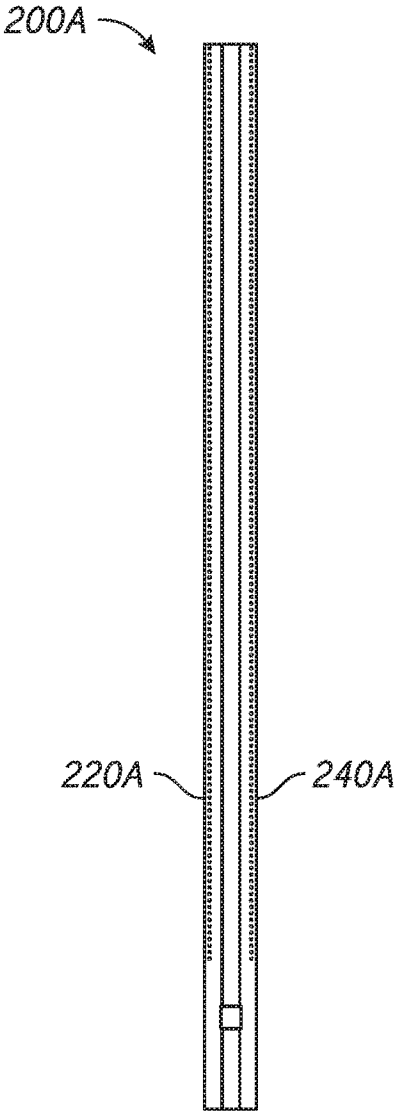
FIG. 4 is a front elevational view of a modification of the fencepost illustrated in FIG. 2.

FIGS. 4 and 5 illustrate a modification of the fencepost 200 identified generally by the reference numeral 200A. Parts, components, features, and advantages of the fencepost 200A that are the same or similar to corresponding parts, features, components, and advantages of fencepost 200 are identified with the same reference numerals used above, except that a letter "A" has been added thereto.

With continued reference to FIGS. 4 and 5, the elongated fencepost member 202A of the post 200A can include generally parallel first and second sidewalls 208A and 210A. The center wall 212A can connect the first and second sidewalls 208A, 210A and extend through an arcuate shape between the sidewalls 208A, 210A.

The arcuate shape of the center wall 212A results in the elongate fencepost member 202A as having a generally U-shaped cross-section. As used herein, the phrase "generally U-shaped cross-section" to include the cross-section illustrated in FIG. 5 in which the first and second sidewalls 208A, 210A are generally but not perfectly parallel and the center wall 212A is arcuate forming a concave shape extending inwardly to interior of the elongated fencepost member 202A.

The arcuate shape of the center wall 212A can provide additional optional benefits. For example, the arcuate shape of the center wall 212A can result in a higher overall stiffness of the post 200A.

Similarly to that described above with reference to FIG. 3, the post 200A can include first and second flanges 220A, 240A, having pluralities of apertures 226A, 246A, respectively.

Figure 6:
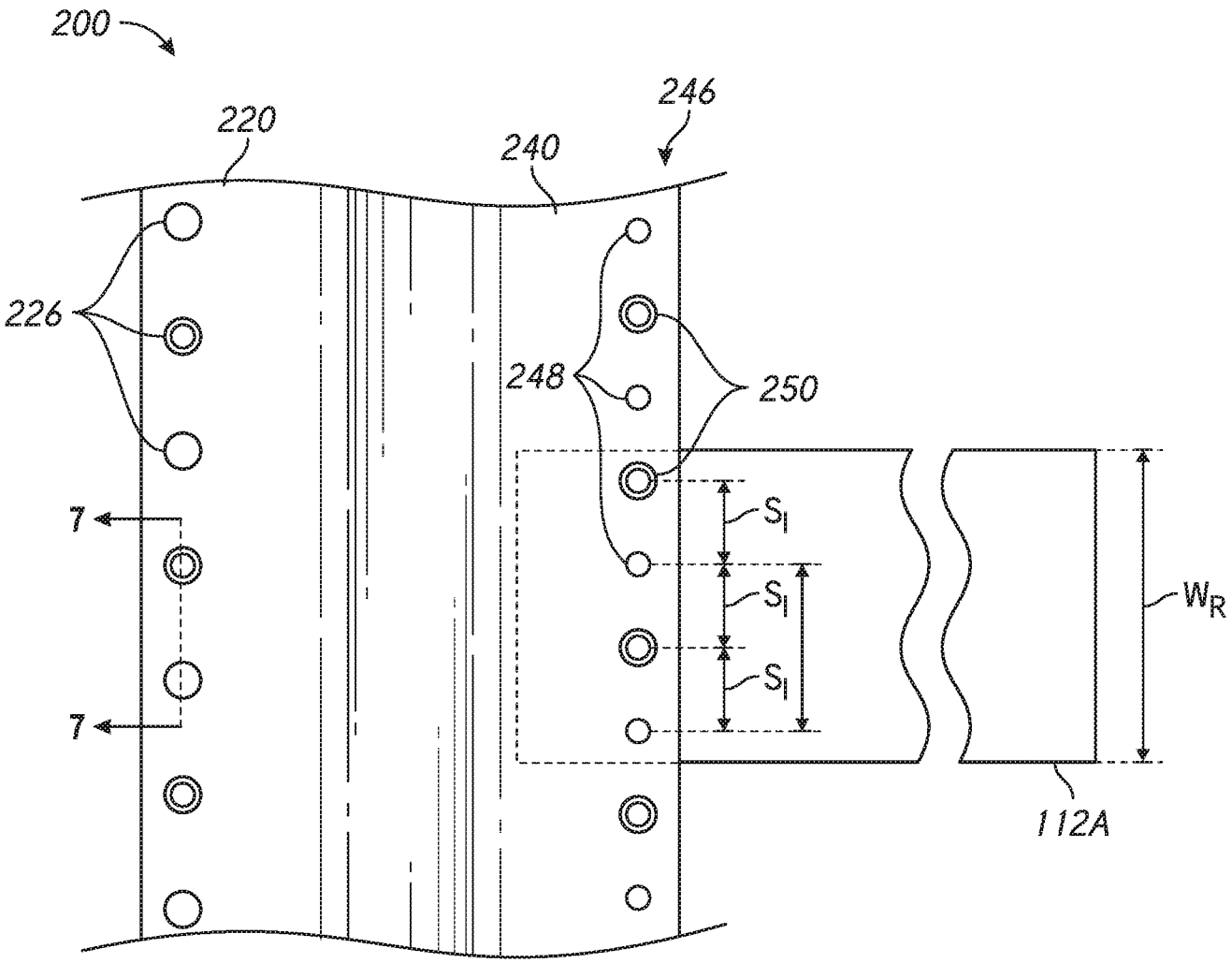
FIG. 6 is an enlarged front elevational view of the fencepost of FIG. 2 illustrating an alternating pattern of pre-drilled openings in the flanges thereof.
Figure 7:
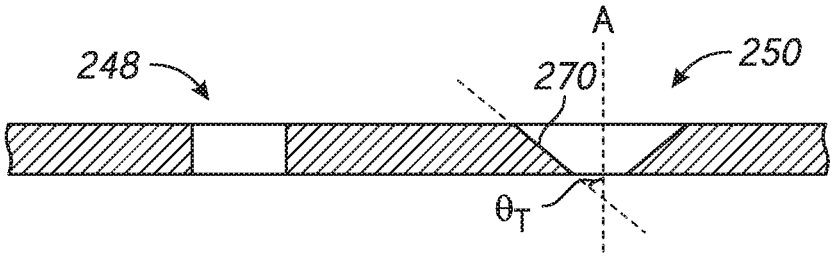
FIG. 7 is a sectional view of straight and countersunk openings included in the fenceposts of FIG. 2, taken along line 7.-7. of FIG. 6.
Figure 8:
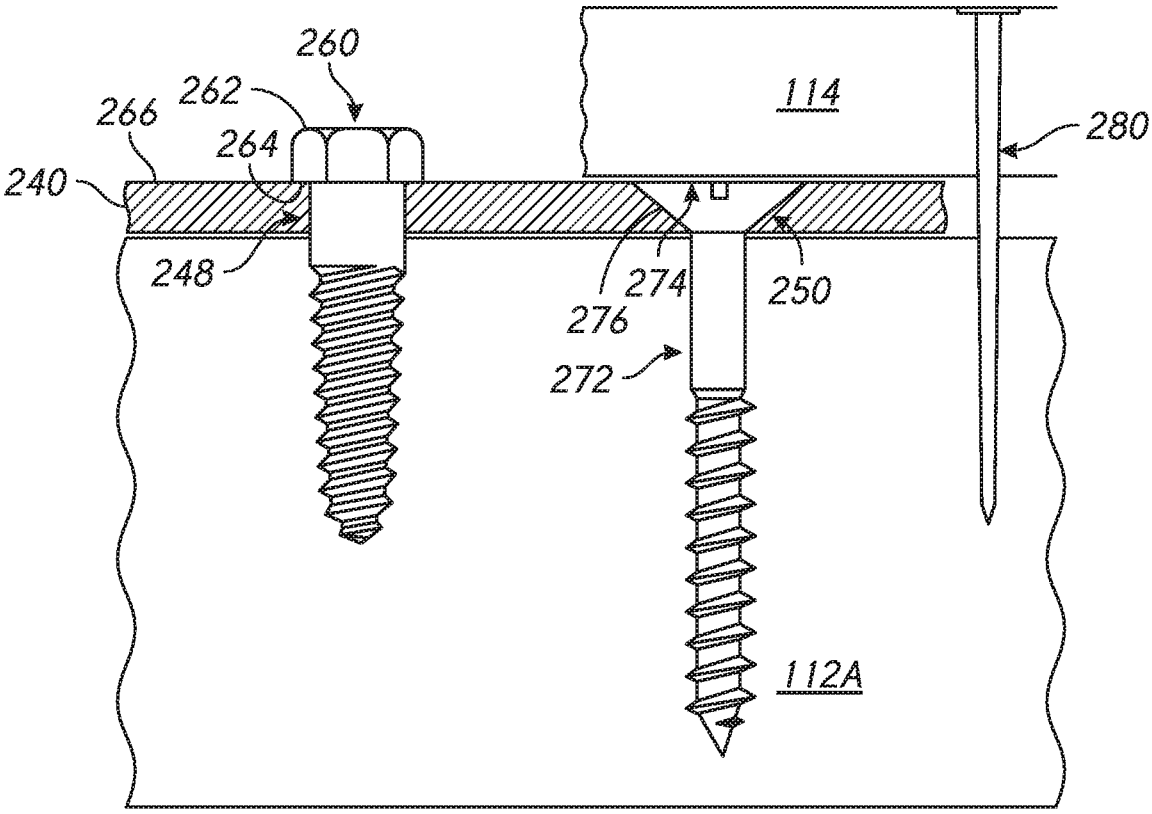
FIG. 8 is an additional view of the enlarged portion of the fencepost including the fasteners extending through the straight and countersunk openings, with a fence rail and a fence board attached thereto.

FIGS. 6-8 includes enlarged sectional and cutaway views of the post 200 with details regarding the plurality of apertures 226, 246. The descriptions of the embodiments illustrated in FIGS. 6-8 also apply equally to the embodiments of FIGS. 4 and 5 as well as any other fenceposts, corner posts, T-post, or gatepost described in the present disclosure. However, only fencepost 200 will be referenced with regard to the description of FIGS. 6-8.

With continued reference to FIGS. 6-8, as described above, the first and second flanges 220, 240 of the fencepost 200 can include pluralities of openings 226, 246, respectively. In some embodiments, one or both of the pluralities of openings 226, 246 can include an alternating pattern of straight openings and countersunk openings. For example, the plurality of openings 246 can include a plurality of straight openings 248 and a plurality of countersunk openings 250. As shown in FIG. 6, the alternating pattern can be defined by a series of openings including one straight opening 248 followed by one countersunk opening 250, followed by another straight opening 248, followed by another countersunk opening 250, for example, in direction from the upper end 204 of the post toward the lower end 206 of the post 200.

The spacing of the straight and countersunk openings 248-250 can be sufficiently close so as to provide optional benefits and/or efficiencies in constructing a fence, such as the fencing system 100. For example, with continued reference to FIG. 6, a fence rail 112A is illustrated as being aligned with a portion of the flange 240. In some embodiments, the plurality of openings 246 are spaced sufficiently close such that at least two straight openings 248 or at least two countersunk openings 250 align with portions of the rail 112A. For example, the rail 112A can have a width $W_R$ that is equal to the standard width dimension of a 2×4 which can be approximately between 3½ inches and four inches (for a "true dimension" 2×4). Thus, in some embodiments, the interhole spacing $S_I$ is about one inch or less. As used herein, the interhole spacing $S_I$ illustrated in FIG. 6 is a center-to-center measurement of adjacent holes, e.g., the distance between a center of a straight opening 248 to a center of a countersunk opening 250. Other measurement techniques can also be used. With such a spacing $S_I$, at least two straight openings 248 or two countersunk openings 250 would fit within the width $W_R$.

Further, additional benefits can also be achieved where the spacing $S_I$ is sufficient to allow at least two straight opening 248 and at least two countersunk openings 250 to lie within a span of the width $W_R$. As such, for any one position in which the rail 112A might be positioned, there are both two straight openings 248 and two countersunk openings 250 that are aligned with a portion of the rail 112A.

Thus, for example, an installer might choose a position of the rail 112A such as that illustrated in FIG. 6, and then can choose whether to use tapered fasteners or regular fasteners. For example, if an installer intended to cover the flanges 220, 240 with fence boards, she may choose to use tapered fasteners in cooperation with the countersunk openings 250. Or, if the installer so chose, he could use regular fasteners inserted through the straight openings 248.

With continued reference to FIGS. 7 and 8, the straight openings 248 can be in the form of holes typically known and referred to as "straight holes" used in the industry. The holes can be drilled with straight-sided drill bits or punched with straight-sided punching devices. These holes 248 are designed and intended to be used with regular screws or lag bolts 260 which have an enlarged head 262 and a flat bottom surface 264. The flat bottom surface 264 properly contacts an outwardly-facing surface 266 of the flange 240. Optionally, a washer (not shown) can be placed between surface 264 and the outward surface 266.

By contrast, the countersunk openings 250 can include slanted sidewall surfaces 270. The slanted sidewall surface 270 can be conical in shape, as is typical for such countersunk openings which are well known in the art. The slanted sidewalls 270 can form an angle $\theta_T$ relative to an axial direction A of the opening 250. The angle $\theta_T$ can be any angle usable for countersunk holes purposes. In some embodiments, the angle $\theta_T$ is between 30 and 60 degrees, and in some embodiments about 40 degrees. Other angles can also be used.

With the configuration of a countersunk hole, the countersunk opening 250 can accept fasteners such as the countersunk fastener 272 which includes a flat upper surface 274 and slanted or conical sidewalls 276 which are slanted in an angle to approximately correspond to the slant of the sidewalls 270. As such, the fastener 272 can be driven through the opening 250 until the sidewalls 276 of the fastener 272 contact the sidewalls 270 of the countersunk opening 250. As such, the upper surface 274 of the fastener 272 can be flush or substantially flush with the upper surface 266 of the flange 240. As such, a fence board 114 can be positioned over the fastener 272 and attached directly to a fence rail 112A, for example, with a nail 280, or any other type of fastener, while making contact across a broad portion of the outer surface 266 of the flange 240 and being spaced away from the fence rail 112A by a distance equal to the thickness of the flange 240.

Figure 11:
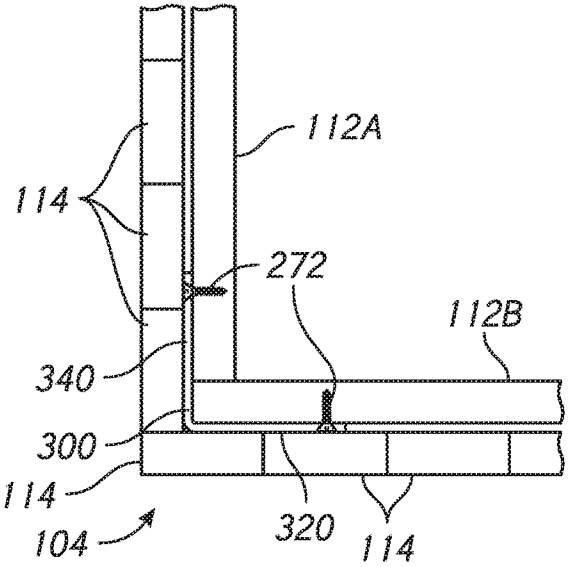
FIG. 11 is a schematic top plan view of an optional use of the fencepost of FIG. 9.
Figure 10:
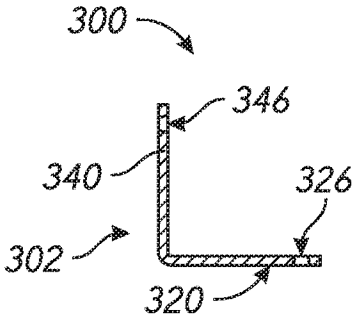
FIG. 10 is a top plan view of the fencepost of FIG. 9.
Figure 9:
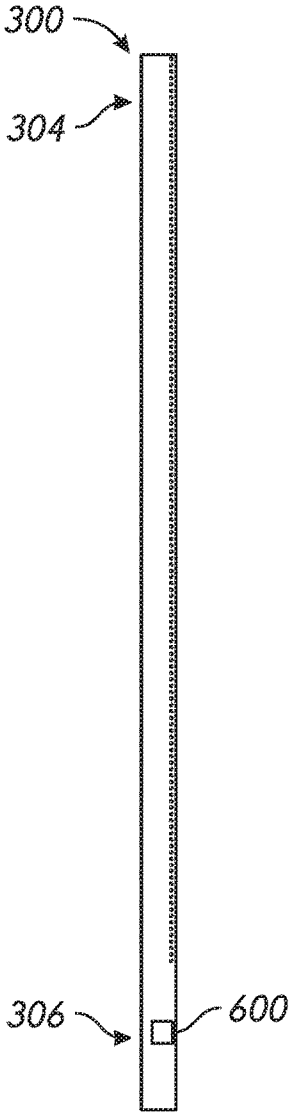
FIG. 9 is a front elevational view of a further modification in the fencepost of FIG. 2.

FIGS. 9-11 illustrate a corner post 300 which, in some embodiments, shares some parts, components, features, and advantages of the post 200 and thus can be considered as a modification of the post 200. Thus, certain parts, components, and features of the post 300 which are similar to the same as corresponding parts, components, and features of the fence post 200, are identified with the same reference numeral used above with regard to fencepost 200, except that "100" can been added to those reference numerals.

With continued reference to FIGS. 9-11, the corner post 300 can include an elongated fencepost member 302. In the illustrated embodiment, the elongated fencepost member 302 is in the form of structural stock material known as "angle iron" or "angle steel."

The corner post 300 can also include first and second flanges, 320, 340 configured for attachment to fencing components such as fence rails 112A, 112B (FIG. 11). The flanges 320, 340 can be formed as separate pieces attached to the elongated fencepost member 302 or formed with the elongated fencepost member 302 in a single monolithic piece.

In some embodiments, the flanges 320, 340 include pluralities of apertures 326, 346, respectively. The pluralities of apertures 326, 346 can include alternating patterns of straight openings and countersunk openings, as described above with reference to the pluralities of openings 226, 246.

With reference to FIG. 11, a fencing system 100 including a corner section 104 can be constructed with a corner post 300 as reflected by the top plan view of FIG. 11. For example, fence rails 112A, 112B can be secured to flanges 340, 320, respectively, by way of fasteners engaged with the pluralities of openings 346, 326, respectively. For example, the countersunk screws 272 can be secured to two or more countersunk openings 250 disposed in the flanges 320, 340 and engage the rails 112A, 112B. After such attachment of the flanges 320, 340 to the rails 112B, 112A, respectively, fence boards 114 can be secured over the exposed heads 274 of the fasteners 272. In some embodiments, fence boards 114 can be attached directly to rails 112A, 112B or attached to the corner posts 300 with adhesive. Other techniques can also be used.

Figure 14:
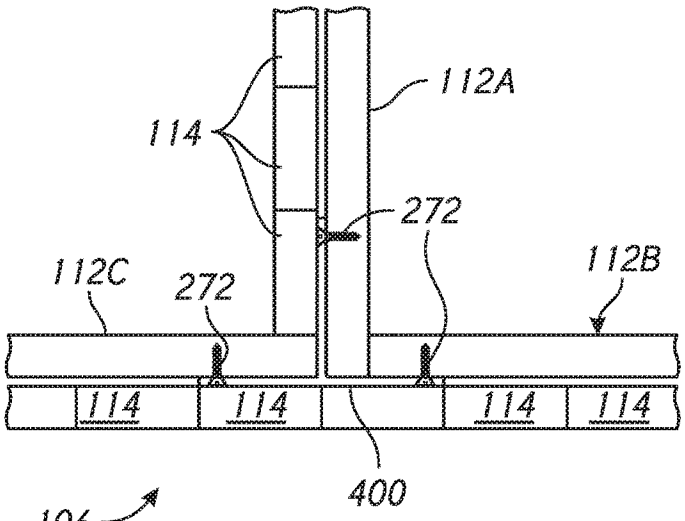
FIG. 14 is a top plan view of an optional use of the fencepost of FIG. 12 incorporated into a fencing section.
Figure 13:
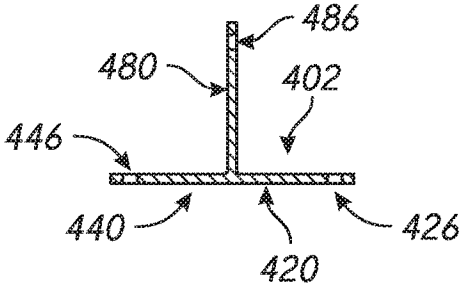
FIG. 13 is a top plan view of the fencepost of FIG. 12.
Figure 12:
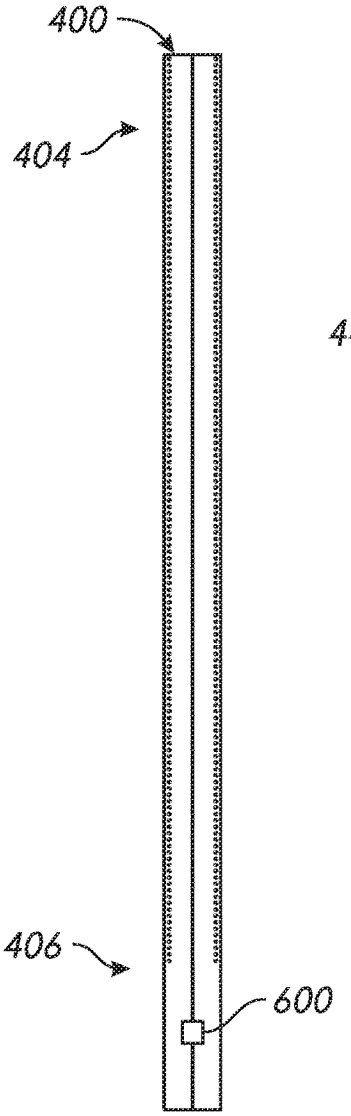
FIG. 12 is a front elevational view of yet another modification of the fencepost of FIG. 2.

FIGS. 12-14 illustrate a T-post 400 which can be used for constructing a T-section 106 (FIG. 1) of a fencing system 100. The T-post 400 can be considered as a modification of the fencepost 200. Thus, parts, components, and features of the T-post 400 that are similar or the same as corresponding parts, components, features of the fencepost 200 are identified using the same reference numerals, except that "200" has been added to the reference numerals of fencepost 200.

With reference to FIG. 13, the T-post 400 can include an elongated fencepost member 402 that has a generally T-shaped cross-section. As such, the elongated fencepost number 402 can be formed from standard stock steel formed with a T-shaped cross-section.

The T-post 400 also includes first flange 420, a second flange 440, and a third flange 480. The flanges 420, 440, 480 can be added to an elongated fencepost number 402 having a T-shaped cross-section, for example by butt welding or the flanges 420, 440, 480 can be considered as modified portions of a single monolithic member with a T-shaped cross-section. Similarly to the posts 200 and 300 above, the flanges 420 and 440 can include pluralities of apertures 426, 446. Additionally, the flange 480 can include a plurality of apertures 486. One, two or all three of the pluralities of openings 426, 446, 486 can comprise alternating patterns of straight and countersunk openings, such as those described above with reference to FIG. 6.

With reference to FIGS. 12 and 14, the T-post 400 can be used for constructing a T-section 106 of a fencing system 100. For example, fence rails 112A, 112B and 112C can be attached to the T-post 400 with fasteners 272 used in conjunction with countersunk openings 250 in the T-post 400. Additionally, fence boards can be attached to the rails 112A, 112B, 112C with other fasteners and/or can be glued to portions of the T-post 400. Other attachment techniques can also be used.

Figure 15:
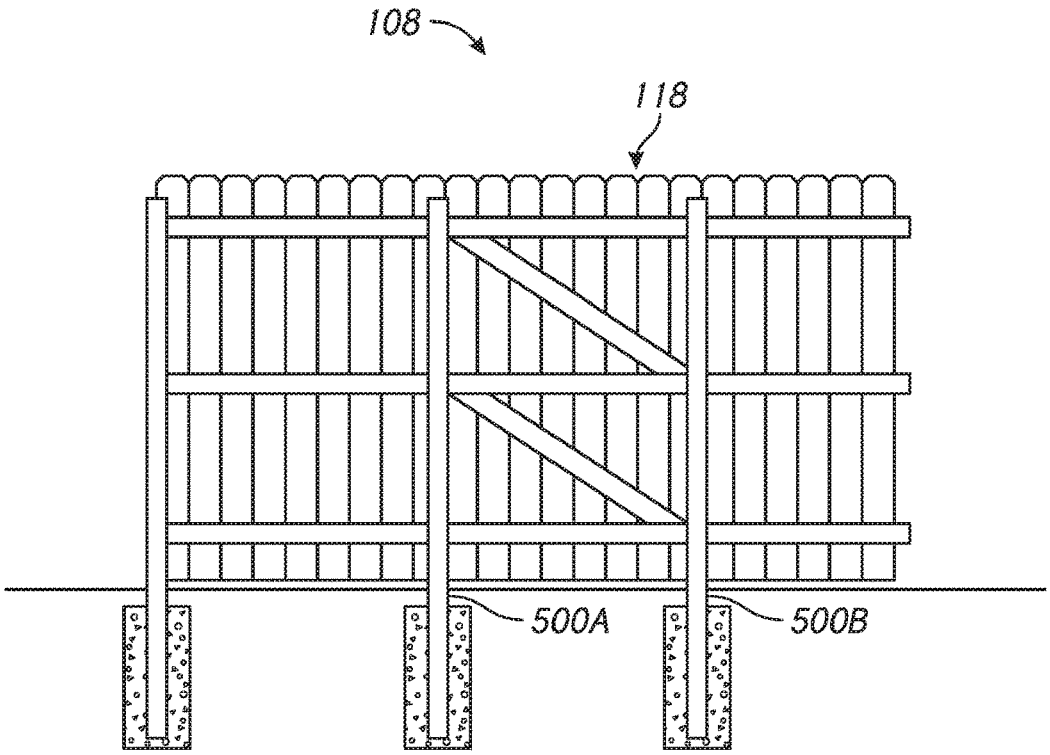
FIG. 15 is a rear elevational view of a gate assembly of the fencing system of FIG. 1.
Figure 16:
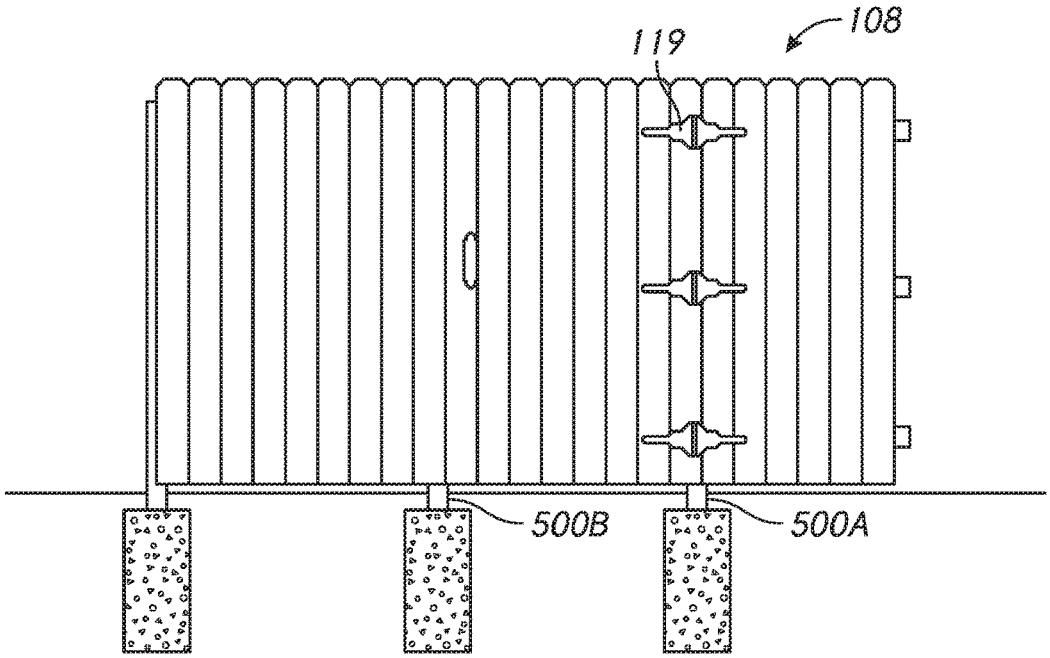
FIG. 16 is a front elevational view of the gate assembly of FIG. 15.
Figure 20:
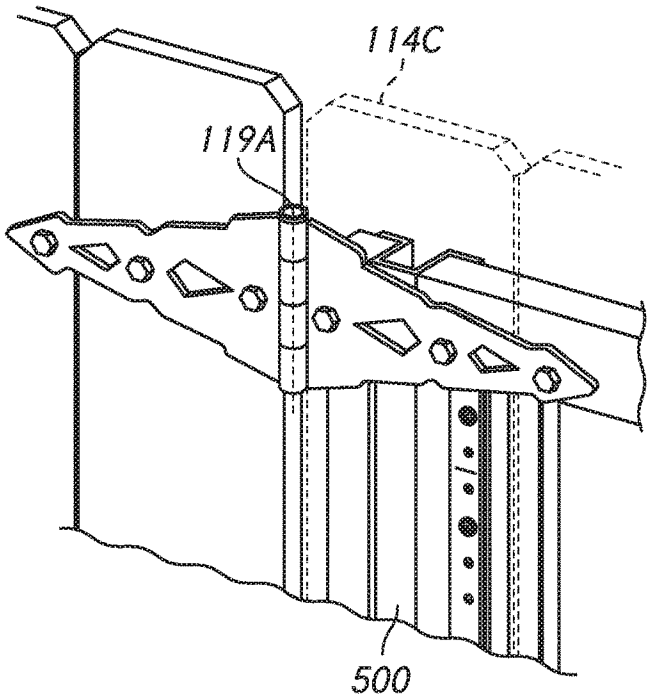
FIG. 20 is an enlarged perspective view of a hinge and gatepost illustrated in FIG. 19.

With reference to FIGS. 15 and 16, a gate section 108 of a fencing system 100 can be constructed with one or more gateposts 500. For example, the gate section 108 can include the first gatepost 500A and optionally, a second gatepost 500B. In the illustrated embodiment, the gate section 108 includes a hingedly mounted gate panel 118 connected to the gatepost 500A with a plurality of hinges 119. The hinges 119 support the gate panel 118 for pivoting movement about a hinge axis 119A (FIG. 20).

Figure 18:
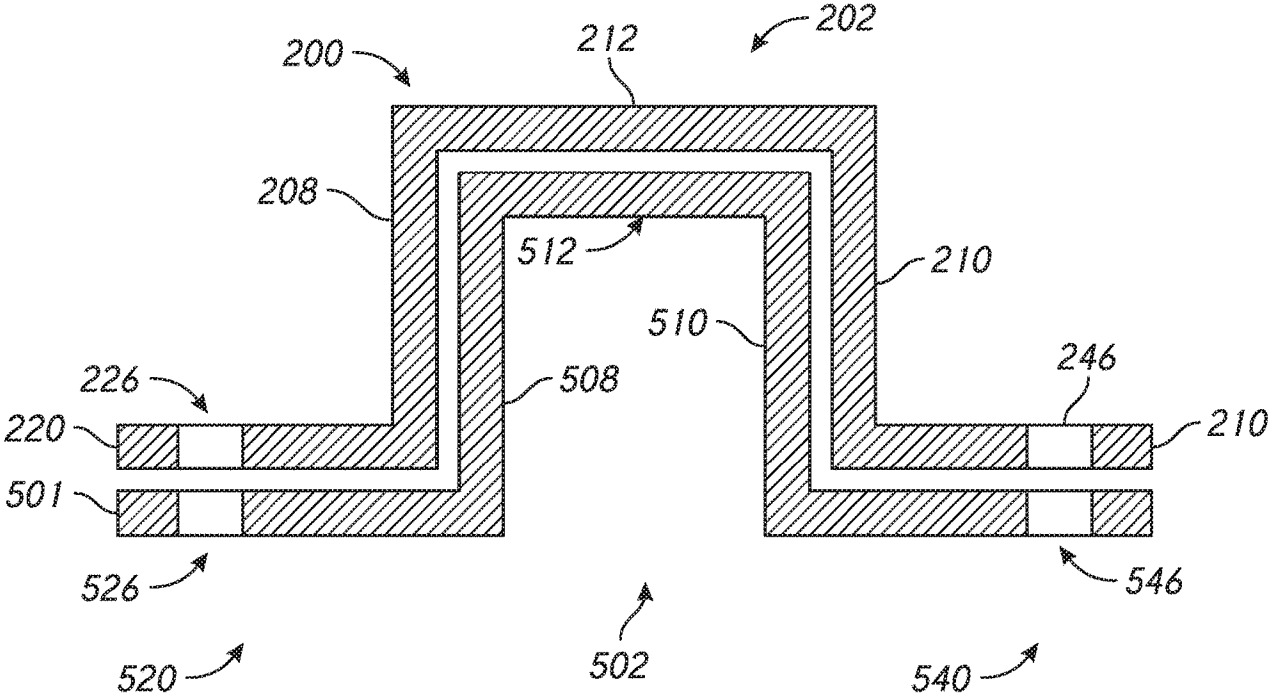
FIG. 18 is a schematic top plan view of the gatepost of FIG. 17.
Figure 17:
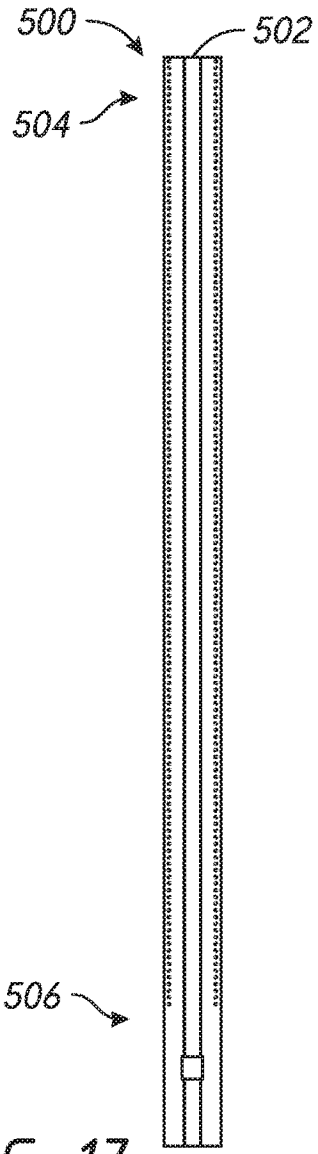
FIG. 17 is a front elevational view of a gatepost included in the gate assembly of FIGS. 15 and 16.

With reference to FIGS. 17 and 18, the gatepost 500, like the gatepost 200, can include an elongated fencepost member 502 and flanges 520 and 540. Optionally, the gatepost 500 can be formed with a fencepost member 200 and a secondary layer 501. Thus, the gatepost 500 can present an opportunity for savings in reducing the number of unique components for creating the fencing system 100.

With continued reference to FIG. 18, the secondary layer 501 can include parts forming the same or a complimentary cross-sectional shape with that of the fencepost 200. For example, the elongated fencepost portion 502 can include the first sidewall 508, second sidewall 510, and a center wall 512. The center wall 512 can connect the sidewalls 508, 510. Together, the sidewalls 508, 510 and center wall 512 form an elongated, generally U-shaped channel member portion 502. Additionally, this cross-sectional shape is complementary to the cross-sectional shape defined by the walls 208, 210, and 212. Thus, as shown in FIG. 18, the generally U-shaped configuration of the walls 508, 510, 512 can nest with the walls 208, 210, 212.

The secondary layer 501 also includes flange portions 520, 540, which can have generally the same orientation as the flanges 220, 240, respectively. Further, the secondary layer 501 can include pluralities of apertures 526, 546 which can also include alternating patterns of straight and countersunk holes. Further, the openings 526, 546 can be concentrically aligned with the plurality of openings 226, 246. Thus, the plurality of openings 526 and the plurality of openings 226, can define a plurality of axially aligned openings which can be used for fastening rails and/or other components to the gate post 500. The plurality of openings 546, 246 can also be aligned as such.

Optionally, the fencepost 200 and secondary layer 501 can be attached to each other by fasteners extending through openings 226, 526, 246, 546, by welding, adhesive, or other attachment techniques.

Figure 19:
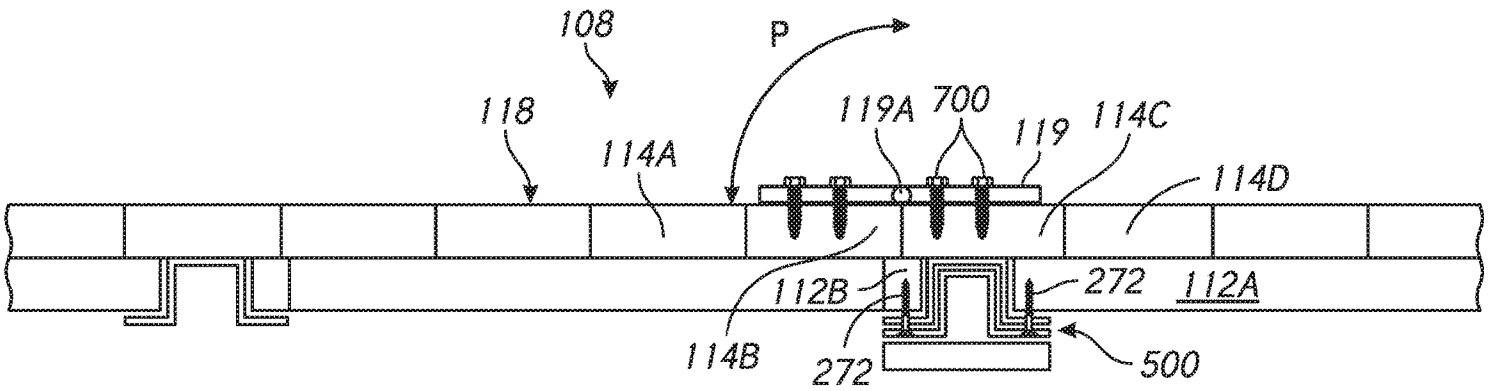
FIG. 19 is a schematic top plan view of the gate assembly of FIGS. 15 and 16 illustrating an optional mounting location of the gatepost of FIG. 17.

With reference to FIGS. 19 and 20, the gatepost 500 can be used to support one or both sides of a gate assembly 108. For example, as shown in FIGS. 19 and 20, the gatepost 500 can be attached to fence rail 112A and fence rail portion 112B with fasteners, for example 272. A fence board 114C can be attached to the rail 112A and rail portion 112B with fasteners (not shown). The hinge 119 can further be attached to the fence board 114C with additional fasteners 700. As such, structurally, the fixed portion of the hinge 119 is supported by the gatepost 500. The swivel portion of the hinge 119 can be attached to fence board 114B which is part of the pivotal fence panel 118 and which pivots around the hinge axis 119A along the direction of arrow P.

Figure 21:
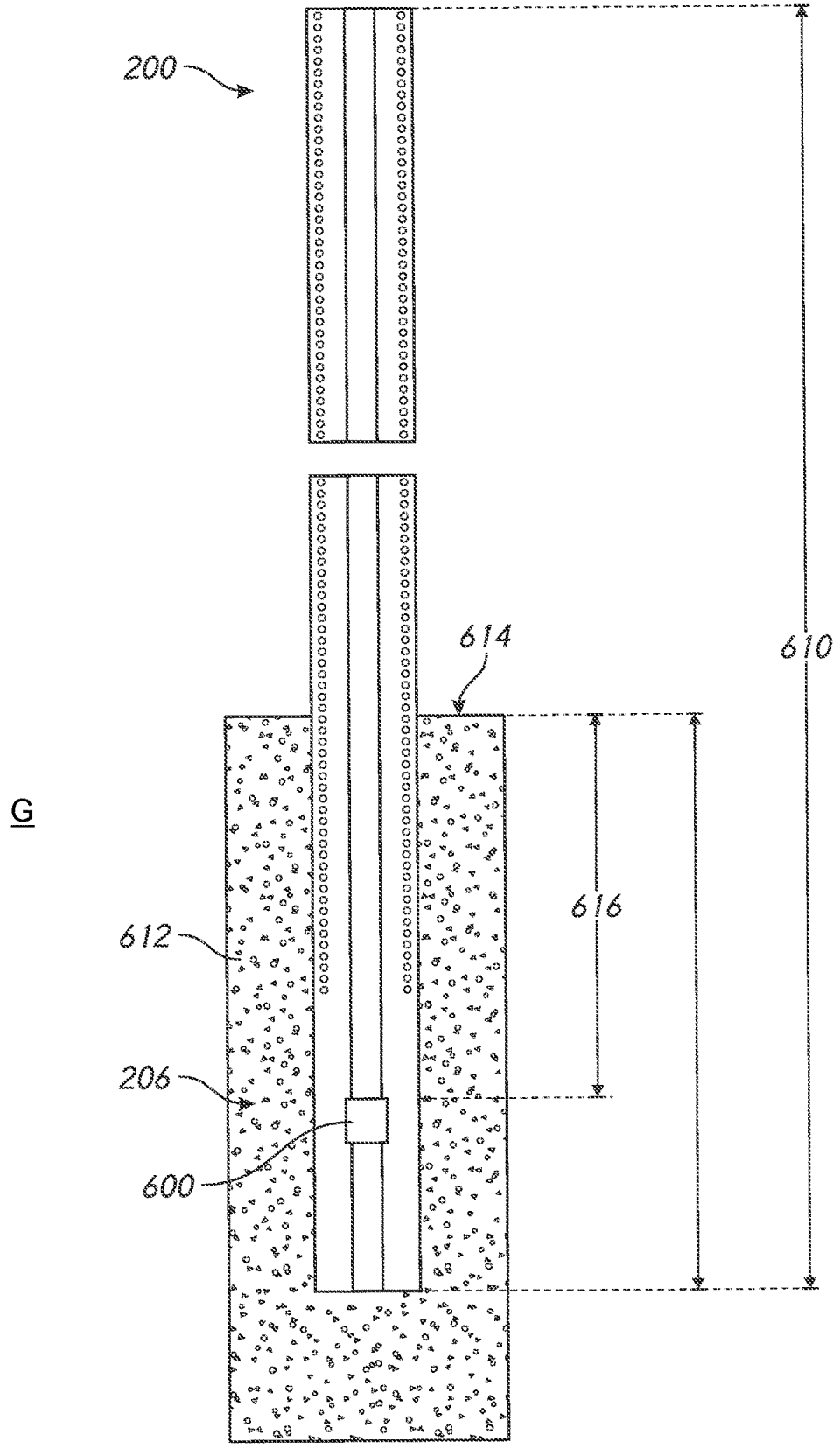
FIG. 21 is a front elevational and partial cutaway view of an embodiment of a fencepost having a concrete lock.
Figure 22:
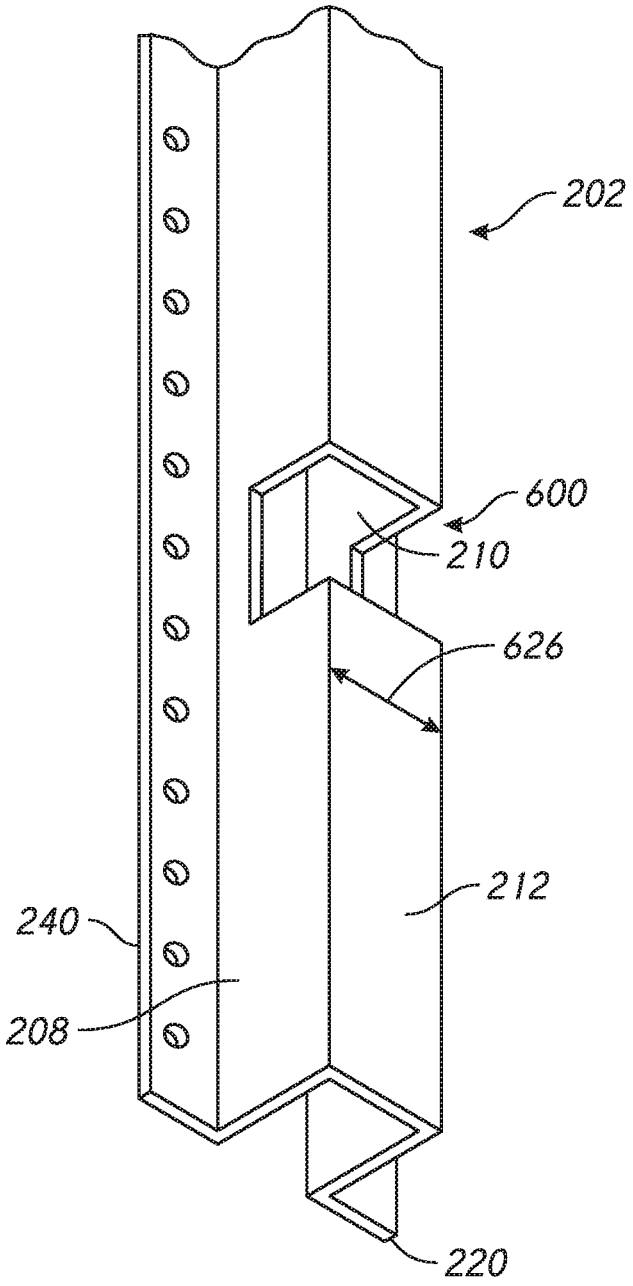
FIG. 22 is an enlarged perspective view of the concrete lock of the fencepost of FIG. 21.
Figure 23:
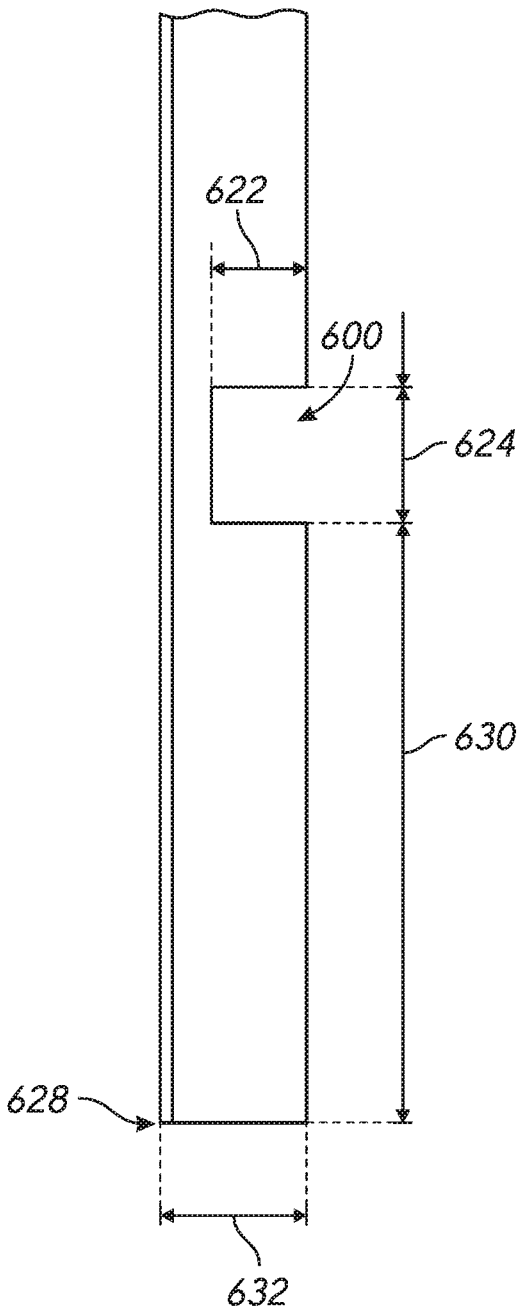
FIG. 23 is an enlarged side elevational view of the concrete lock of FIG. 22.

With reference to FIGS. 21-23, the cement lock 600 can be provided on any of the posts 200, 300, 400, 500. The illustrated embodiment of the cement lock 600 in FIGS. 21-23 is illustrated as being formed on the fencepost 200. However, the disclosure of the various embodiments of the cement lock 600 illustrated in FIGS. 21-27 are intended to apply to all of the posts 300, 400, and 500 as well.

With reference to FIG. 21, the fencepost 200 can have an overall length of 610. For example, in some embodiments, the overall length 610 can be from about 6 to about 10 feet. Some embodiments can be 8 feet long. Other lengths can also be used.

The fencepost 200 is designed for and intended to be inserted into the ground G. In some embodiments, the fencepost 200 can be fixed to a concrete footing 612. The concrete footing 612 can be prepared and constructed in accordance with techniques well-known in the art.

In accordance with some embodiments, the fencepost 200 is inserted into the concrete footing 612 sufficiently such that the concrete lock 600 is spaced from the upper surface 614 of the concrete footing 612 by a depth 616 of at least 12 inches. In some embodiments the depth 616 can be approximately one and one-third feet or approximately 16 inches.

An aspect of at least one of the inventions disclosed herein includes the realization that while a concrete lock aperture such as the concrete lock 600 can provide for enhanced flow of concrete therethrough when the concrete footing 612 is still flowable, prior to full curing, the concrete lock 600 does compromise the strength of the fencepost 200 with regard to wind and uplift loads imparted onto fencepost 200. For example, the removal of the material from the lower end 206 of the fencepost 200 reduces the strength of the lower end 206 of the fencepost 200 in bending and tensile loading. However, an aspect of at least one of the inventions disclosed herein includes the realization that by inserting the fencepost 200 such that the concrete lock 600 is spaced from the upper surface 614 by a spacing 616 of at least about 12 inches, the concrete lock aperture, and the associated reduction in strength of the lower end 206 of the fencepost 200 is spaced sufficiently away from the upper surface 614 so as not to compromise the strength and stiffness of the fencepost in the vicinity of the upper surface 614. However, the concrete lock 600, at such a depth, retains the ability to provide the additional securing function by accommodating a high volume and cross sectional area of flow through the concrete lock and thus provide enhanced and robust securement of the fencepost 200 to the concrete footing 612.

For example, in some embodiments, with reference to the FIGS. 22 and 23, the opening defining the concrete lock can incorporate portions of the sidewalls 208, 210 and the center wall 212 of the elongated fencepost member 202. This can provide an additional benefit in providing additional loading of all three walls 208, 210, 212 of the elongate fencepost 202 by way of allowing significant flow of concrete through the lock 600 during the installation process thereby resulting in a large cross-sectional portion of concrete hardening within the concrete lock 600. This enhances the ability of the concrete to provide reactionary load against edges of the concrete lock 600 that extend into the sidewalls 208, 210, and center wall 212. For example, an upward force on the fenceposts 200 which may be generated by wind or other loads, will be resisted by tensile loads applied to the walls 208, 210, 212 by hardened concrete extending through the concrete lock 600. Further, although the concrete lock 600 extends through the entirety of the width of the wall 212 and portions of the walls 208 and 210, the concrete lock 600 is sufficiently below the upper surface 614 so as to not affect the bending strength of the fencepost 200 in the vicinity of the upper surface 614.

Another aspect of at least one of the inventions disclosed herein includes the realization that concrete typically used for footings 612 for fence posts can include significant amounts of granular materials, such as stones, which can have one or more dimensions of about 1½ inches or more, some such granular materials can have non-uniform and non-round shapes. The inclusion of granular materials of such dimensions can negatively impact the flowability of the concrete when the concrete is poured during construction of a footing 612. Thus, when used for a fence post footing, the larger granular materials can impede flow of the associated concrete through a concrete lock aperture 600, 600A, 600B. In accordance with some embodiments, the height 624, 624A, 624B of the concrete lock can be at least 2.5 inches and in some embodiments, at least about three-inches and a width 622, 622A, 622B of at least about one-inch. With such a configuration, the concrete lock 600, 600A, 600B, better allows larger pieces of granular material included in the concrete during construction of a footing 612, to flow through the concrete lock 600, 600A, 600B and prevent the blockage of the concrete lock 600, 600A, 600B and thereby prevent the formation of large voids around the concrete lock 600, 600A, 600B and better anchor the associated fence post in the footing 612.

Thus, in some embodiments, the concrete lock 600 can have a depth 622 of about one-inch, a height 624 of about two-inches and in some embodiments about three-inches and a width 626 of approximately two-inches. Other dimensions can also be used. In some embodiments, the concrete lock 600 can be spaced from the lower edge 628 of the fencepost 200 by a spacing 630 which can be in some embodiments, approximately six inches.

Figure 24:
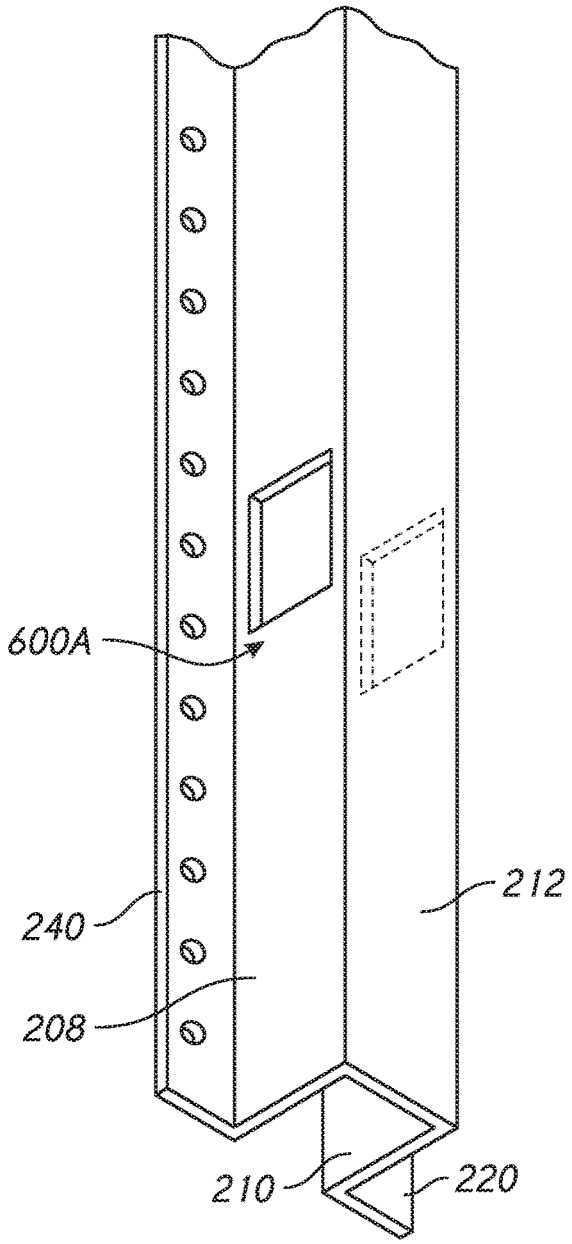
FIG. 24 is a perspective view of a modification of the concrete lock illustrated in FIGS. 21-23.

FIG. 24 illustrates a modification of the concrete lock 600, identified generally by the reference numeral 600A. Parts, components, and features of the concrete lock 600A which are similar or the same as corresponding parts, components, or features of the concrete lock 600 are identified with the same reference numerals, except that a letter "A" have been added thereto.

Figure 25:
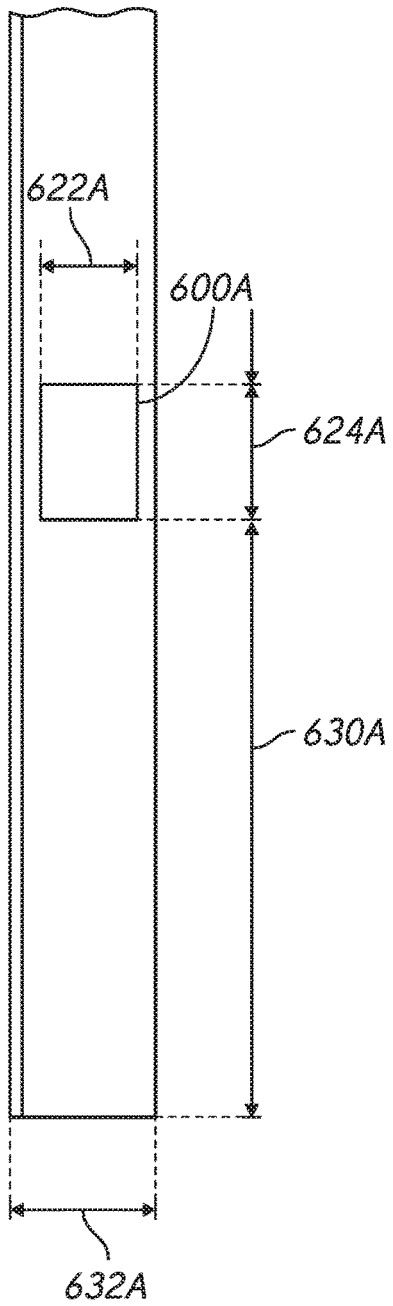
FIG. 25 is an enlarged side elevational view of the concrete lock illustrated in FIG. 24.
Figure 26:
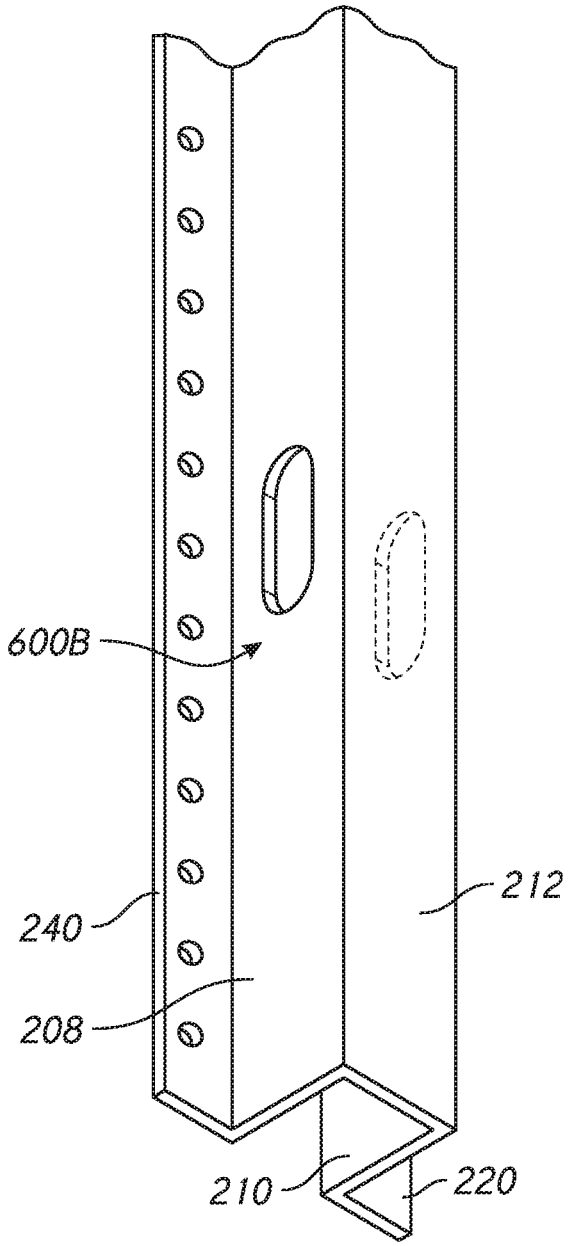
FIG. 26 is a perspective view of yet another modification of the concrete lock illustrated in FIGS. 21-23.

With reference to FIGS. 24 and 25, the concrete lock 600A is defined by concrete lock openings extending through both sidewalls 208, 210, but not the center wall 212. Rather, the concrete lock 600A is defined by a pair of aligned apertures extending through both sidewalls 208, 210. With reference to FIG. 26, the dimensions 622A, 624A, 630A and 632A can be about one-inch, three-inches, six-inches, and 1½-inches, respectively.

Figure 27:
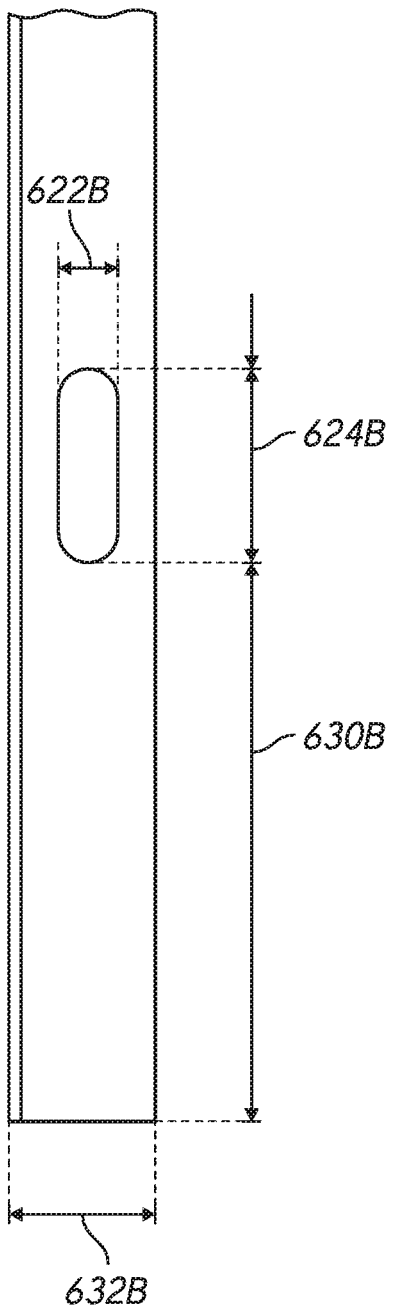
FIG. 27 is a side elevational view of the concrete lock illustrated in FIG. 26.

FIGS. 26 and 27 illustrate yet another modification of the concrete lock 600, identified generally by the reference numeral 600B. Parts, components, and features of the concrete lock 600B which are similar or the same as corresponding parts, components, or features of the concrete lock 600 or 600A are identified with the same reference numerals, except that a letter "B" have been added thereto, or the letter "A" has been replaced with the letter "B".

With continued reference to FIGS. 26 and 27, the concrete lock 600B is generally oval in shape. Similarly to that of concrete lock 600A, the concrete lock 600B is formed by a pair of aligned apertures and side walls 208, 210, but does not extend through the center wall 212.

This arrangement of concrete lock apertures can provide the additional optional benefit of providing a capture of a large cross-sectional piece of hardened concrete, following the installation of the fencepost 202 to a concrete footing 612, while preserving the tensile and bending strength of the center wall 212. Further, the apertures forming the concrete locks 600A and 600B, being disposed between the center wall 212 and the flanges 220, 240 can thereby provide a more balanced loading of the fencepost 200 by way of the interaction of hardened concrete with the concrete lock 600A, 600B.

With continued reference to FIG. 27, the dimensions 622B, 624B, 630B, and 632B can be about one-inch, three-inches, six-inches, and 1½-inches, respectively. Other dimensions can also be used.

Although the present inventions have been described in terms of certain embodiments, other embodiments apparent to those of ordinary skill in the art also are within the scope of the present inventions disclosed herein. Thus, various changes and modifications may be made without departing from the spirit and scope of the inventions. For instance, various components may be repositioned as desired. Moreover, not all of the features, aspects and advantages are necessarily required to practice any one of the present inventions.

What is claimed is:

1. A steel fence post for an in-line wooden fence, comprising:

an elongated generally U-shaped channel member having a longitudinal length of at least about seven feet, a first side wall, a second side wall extending parallel to the first side wall, and a center wall extending perpendicular to the first and second side walls and connecting the first and second side walls, the first side wall, second side wall, and center walls forming a U-shaped channel, the elongated generally U-shaped channel member having a lower end and an upper end, the lower end configured to be inserted into the ground, wherein the first and second side walls each have a width dimension at least as large as a thickness of a standard two-by-four wood rail;

a first flange having a first inner edge connected to the first side wall and a first outer edge, the first flange extending perpendicular to the first side wall and parallel to the center wall, the first flange including a first plurality of spaced openings extending from an upper end of the first plurality of openings to a lower end of the first plurality of openings disposed at a first location spaced away from the lower end of the elongated generally U-shaped channel member;

a second flange having a second inner edge connected to the second side wall and a second outer edge, the second flange extending perpendicular to the second side wall and parallel to the center wall, the second flange including a second plurality of spaced openings extending from an upper end of the second plurality of openings to a lower end of the second plurality of openings disposed at a second location spaced away from the lower end of the elongated generally U-shaped channel member; and a concrete lock opening extending through the first and second side walls of the elongated generally U-shaped channel member, the concrete lock opening being at least about three-inches long and sufficiently large such that wet concrete can flow therethrough, the concrete lock opening being disposed at a position between the lower end of the elongated generally U-shaped channel member and the first and second locations, spaced from the lower end by about six-inches.

2. The fence post of claim 1, wherein the width of the concrete lock opening extends from the first flange to the second flange.

3. The fence post of claim 1, wherein the first plurality of spaced openings extends along the longitudinal length of the first flange in an alternating pattern of straight openings and countersunk openings, wherein the first plurality of openings are spaced sufficiently close such that at least two of the straight openings and at least two of the countersunk openings of the alternating pattern of straight openings and countersunk openings are disposed within a 4-inch span of the first flange along the longitudinal length.

4. A steel fence post for an in-line wooden fence, comprising:

an elongated fence post member having a longitudinal length of at least about 6 feet, a first side wall, a second side wall, a lower end, and an upper end, the lower end configured to be inserted into the ground;

a first flange extending from the first side wall, the first flange including a first plurality of spaced openings configured to receive fasteners;

a second flange extending from the second side wall, the second flange including a second plurality of spaced openings configured to receive fasteners; and a concrete lock opening extending through the elongated fence post member, the concrete lock opening being at least about three-inches long and sufficiently large such that wet concrete can flow therethrough, the concrete lock opening being disposed at a position spaced from the lower end of the elongated fence post member by about six-inches.

5. The fence post of claim 4, wherein the lower end of the elongated fence post member is embedded in a concrete footing with the concrete lock opening disposed at least about sixteen-inches below an upper surface of the concrete footing.

6. The fence post of claim 5, wherein the elongated fence post member comprises a generally U-shaped channel member, wherein the second side wall extends parallel to the first side wall, the generally U-shaped channel member having a center wall extending perpendicular to the first and second side walls and connecting the first and second side walls, the first and second side walls having a width dimension at least as large as a thickness of a standard two-by-four wood rail, the concrete lock opening extending through the first and second side walls of the elongated generally U-shaped channel member.

7. The fence post of claim 6, wherein the concrete lock opening is oval-shaped.

8. The fence post of claim 7, wherein a width of the oval-shaped concrete lock opening is at least about two inches and a height of the oval-shaped profile is at least about three inches.

9. The fence post of claim 4, wherein the width of the concrete lock opening extends from the first flange to the second flange.

10. The fence post of claim 4, wherein the concrete lock opening has a square-shaped profile.

11. The fence post of claim 10, wherein a width of the square-shaped profile is at least about two and a half inches.

12. A steel fence post for an in-line wooden fence, comprising:

an elongated fence post member having a longitudinal length of at least about 6 feet, a first side wall, a second side wall, a lower end, and an upper end, the lower end configured to be inserted into the ground; and a first flange extending from the first side wall, the first flange including a first plurality of spaced openings configured to receive fasteners;

a concrete lock opening extending through the elongated fence post member, the concrete lock opening being at least about two and a half-inches long and sufficiently large such that wet concrete can flow therethrough, the concrete lock opening being disposed at a position spaced from the lower end of the elongated fence post member by about six-inches.

13. The fence post of claim 12, wherein the lower end of the elongated fence post member is embedded in a concrete footing with the concrete lock opening disposed at least about sixteen-inches below an upper surface of the concrete footing.

14. The fence post of claim 13, wherein the elongated fence post member comprises a generally U-shaped channel member, wherein, the second side wall extends parallel to the first side wall, the generally U-shaped channel member having a center wall extending perpendicular to the first and second side walls and connecting the first and second side walls, the concrete lock opening extending through the first and second side walls of the elongated generally U-shaped channel member.

15. The fence post of claim 14, wherein the concrete lock opening is oval-shaped.

16. The fence post of claim 15, wherein a width of the oval-shaped concrete lock opening is at least about two inches and a height of the oval-shaped concrete lock opening is at least about three inches.

17. The fence post of claim 12, wherein the width of the concrete lock opening extends from the first flange to a second flange extending from the second side wall.

18. The fence post of claim 12, wherein concrete lock opening has a square-shaped profile.

19. The fence post of claim 18, wherein a width of the square-shaped profile is at least about two and a half inches.

20. The fence post of claim 12, wherein the first plurality of spaced openings extends along the longitudinal length of the first flange in an alternating pattern of straight openings and countersunk openings, wherein the first plurality of openings are spaced sufficiently close such that at least two of the straight openings and at least two of the countersunk openings of the alternating pattern of straight openings and countersunk openings are disposed within a 4-inch span of the first flange along the longitudinal length.

* * * * *